US005733636A

United States Patent [19]

May

[11] Patent Number: 5,733,636

[45] Date of Patent: Mar. 31, 1998

[54] HEAT-SEALABLE PEELABLE COMPOSITION

[75] Inventor: Timothy J. May, Greenville, Wis.

[73] Assignee: Reynolds Metals Company, Richmond, Va.

[21] Appl. No.: 837,035

[22] Filed: Apr. 11, 1997

Related U.S. Application Data

[60] Division of Ser. No. 419,221, Apr. 10, 1995, Pat. No. 5,604,000, which is a continuation-in-part of Ser. No. 374, 361, Jan. 18, 1995, Pat. No. 5,492,411.

[51] Int. Cl.[6] ..... B32B 7/14; B32B 33/00; C08K 5/01

[52] U.S. Cl. ..... 428/200; 428/40.1; 428/41.3; 428/42.2; 428/202; 428/343; 524/476; 524/477; 524/487; 524/502

[58] Field of Search ..... 428/40.1, 41.3, 428/42.2, 343, 200, 202; 524/476, 477, 487, 502

[56] References Cited

U.S. PATENT DOCUMENTS 5,604,000 2/1997 May ..... 428/40.1

*Primary Examiner*—James C. Cannon
*Attorney, Agent, or Firm*—Alan T. McDonald

[57] ABSTRACT

A closure arrangement for a polymeric bag with first and second opposing films comprises first and second opposing base strips, a first peelable strip of a first color, and a second peelable strip of a second color. An outer surface of the first base strip is attached to an inner surface of the first film. An outer surface of the second base strip is attached to an inner surface of the second film. The first peelable strip is attached to the inner surface of the first base strip, and the second peelable strip is attached to the inner surface of the second base strip. The first and second peelable strips are disposed between the first and second base strips. The second peelable strip is generally parallel to and opposes the first peelable strip. The second color of the second peelable strip is lighter than the first color of the first peelable strip. The first color of the first peelable strip is visible through the second peelable strip when the first and second peelable strips are heat sealed to each other to form a peelable seal. The second color of the second peelable strip substantially masks the first color of the first peelable strip when the peelable seal is broken. Thus, breaking the peelable seal produces an irreversible color change in the peelable seal area. Such an irreversible visual change alerts a consumer that the peelable seal has previously been broken.

11 Claims, 2 Drawing Sheets

HEAT-SEALABLE PEELABLE COMPOSITION

This is a division of Ser. No. 08/419,221, filed Apr. 10, 1995, now U.S. Pat. No. 5,604,000, which is a continuation-in-part of Ser. No. 08/374,361, filed Jan. 18, 1995, now U.S. Pat. No. 5,492,411.

FIELD OF THE INVENTION

The present invention generally relates to heat-sealable peelable compositions for polymeric (plastic) bags. This invention also relates to closure arrangement having a heat-sealable, peelable seal.

BACKGROUND OF THE INVENTION

In many consumer packaging applications, it is important to prevent air or water or the like from passing out of or into a package containing certain products. This is particularly true with respect to meat packages, cheese packages, and the like, for which the contained product must be kept in a constant environment to prevent spoilage. It is also important to protect such products from tampering. In order to preserve the integrity and safety of a product contained within such a package, the periphery of the package must be hermetically sealed. Hermetic seals can be provided by both permanent seals and temporary seals known as peelable seals. Peelable seals are capable of providing a hermetic seal and, at the same time, providing a consumer with access to the contents of a package. A consumer breaks a peelable seal of a package by first grabbing onto opposing film faces to which peelable seal materials are adhered and then pulling the film faces apart. To provide a peelable seal on a package with a reclosable zipper, the package typically uses permanent seals at its side edges and bottom edge and a peelable seal above or below the reclosable zipper at the mouth end of the package. In addition, the peelable seal may be arranged on either the flange/base portions of the zipper or on the packaging film adjacent to the flange portions.

There are a couple of typical approaches for forming peelable seals on reclosable packages having a top and bottom film. One typical approach adheres a multilayered film to each of the opposing inner surfaces of the packaging film (or zipper flange portions) along the length of the mouth end of the package. This results in a first multilayered film on the inner surface of the top film and a second multilayered film on the inner surface of the bottom film. A peelable seal is formed by heat sealing the first and second multilayered films to one another. When a consumer breaks the peelable seal, one or more layers of the second multilayered film will disengage from the other layers of the second multilayered film and remain adhered to the first multilayered film. As a result, the first multilayered film will include at least one additional layer when the peelable seal is broken. The above layer disengagement upon breaking the peelable seal is accomplished by using film layers composed of different polymeric materials and by exploiting the varying bond strengths between the layers.

Another typical approach adheres a layer of film to each of the opposing inner surfaces of the packaging film (or zipper flange portions) and introduces contaminants to one or both of the film layers. When the peelable seal is formed by heat sealing the layers to one another, the bond between them is weak due to the surface contamination. Breaking the peelable seal detaches the layers from one another.

The foregoing described general constructions of polymeric bags and specifically peelable seals create hermetically sealed reclosable packages.

SUMMARY OF THE INVENTION

In one embodiment of the present invention, a composition for a heat-sealable peelable seal comprising ethylene vinyl acetate copolymer (EVA), polyethylene based wax, and polypropylene is provided. The composition can further comprise an ink or a dye to color the peel seal. Preferably, the composition comprises about 20% to about 80% ethylene vinyl acetate copolymer, about 5% to about 60% polyethylene based wax, and about 5% to about 60% polypropylene. A peelable seal prepared from this composition provides a peelable seal with a peel strength of between about 0.5 and 10 pounds per lineal inch of seal width.

A peelable seal is prepared by forming a strip of the heat-sealable, peelable composition and heat-sealing the strip. The heat-sealable, peelable strip can be heat-sealed to a polymeric bag or to a second heat-sealable, peelable strip.

This invention provides, in another embodiment, a method of preparing a heat-sealable, peelable composition. The method comprises admixing ethylene vinyl acetate copolymer, polyethylene based wax, and polypropylene at a temperature of between about 340° and 400° F.

In another embodiment, a closure arrangement for a polymeric bag with first and second opposing films is provided. A heat-sealable peelable strip prepared from the composition described above and is attached to the inner surface of the first film. The peelable strip is heat-sealed to the inner surface of the second film to form a hermetically sealed package. The peelable strip can be colored with an ink or a dye.

When the peelable strip is colored, the opposing film can be colored with a different color. The peelable seal is formed by heat-sealing the peelable strip to the opposing film. Upon formation of the peelable seal, the two colors interact to form a third color or one color is visible through the other color. For example, the color of the peelable seal might be visible through an opaque or lightly colored second film. When the peelable seal is broken, the peel seal area undergoes an irreversible color change. Such an irreversible visual change alerts a consumer that the peelable seal has previously been broken and that the hermetic seal has been breached.

In another embodiment, a closure arrangement for a polymeric bag with first and second opposing films with two heat-sealable, peelable strips is provided. In this embodiment, the two peelable strips are attached to the inner surfaces of the first and second film. The first peelable strip is generally parallel to and opposes the second peelable strip. The two peelable strips are typically of different colors. The peelable seal is formed by heat-sealing the two peelable strips to each other. Upon formation of the peelable seal, the two colors interact to form a third color or one color is visible through the other color. As discussed above, when the peel seal is broken, an irreversible color change alerts a consumer that the hermetic seal has been broken.

Yet another embodiment provides a closure arrangement comprising first and second opposing base strips for a polymeric bag with first and second opposing films. The first base strip comprises a first peelable strip of a first color, and the second base strip comprises a second peelable strip of a second color. An outer surface of the first base strip is attached to an inner surface of the first film. An outer surface of the second base strip is attached to an inner surface of the second film. The first peelable strip is attached to the inner surface of the first base strip, and the second peelable strip is attached to the inner surface of the second base strip. The first and second peelable strips are disposed between the first and second base strips, and the second peelable strip is generally parallel to and opposes the first peelable strip. The second color of the second peelable strip is lighter than the first color of the first peelable strip. The first color of the first peelable strip is visible through the second peelable strip when the first and second peelable strips are heat sealed to each other to form a peelable seal. The second color of the second peelable strip substantially masks the first color of the first peelable strip when the peelable seal is broken. Thus, breaking the peelable seal produces an irreversible color change in the peelable seal area. Such an irreversible visual change alerts a consumer that the peelable seal has previously been broken.

In another embodiment of the present invention, a closure arrangement for a polymeric bag with first and second opposing films comprises a first base strip, a second base strip, and a peelable strip. The second film of the polymeric bag is of a first color, while the peelable strip is of a second color. The first color is lighter than the second color. An outer surface of the first base strip is attached to an inner surface of the first film. The second base strip is generally parallel to and opposes the first base strip, and an outer surface of the second base strip is attached to an inner surface of the second film. The peelable strip is attached to the inner surface of the first base strip and is disposed between the first base strip and the second film. The second color of the peelable strip is visible through the second film when the peelable strip and the second film are heat sealed to each other to form a peelable seal. The first color of the second film substantially masks the second color of the peelable strip when the peelable seal is broken.

BRIEF DESCRIPTION OF THE DRAWINGS

Other objects and advantages of the invention will become apparent upon reading the following detailed description and upon reference to the drawings in which.

Figure 3:
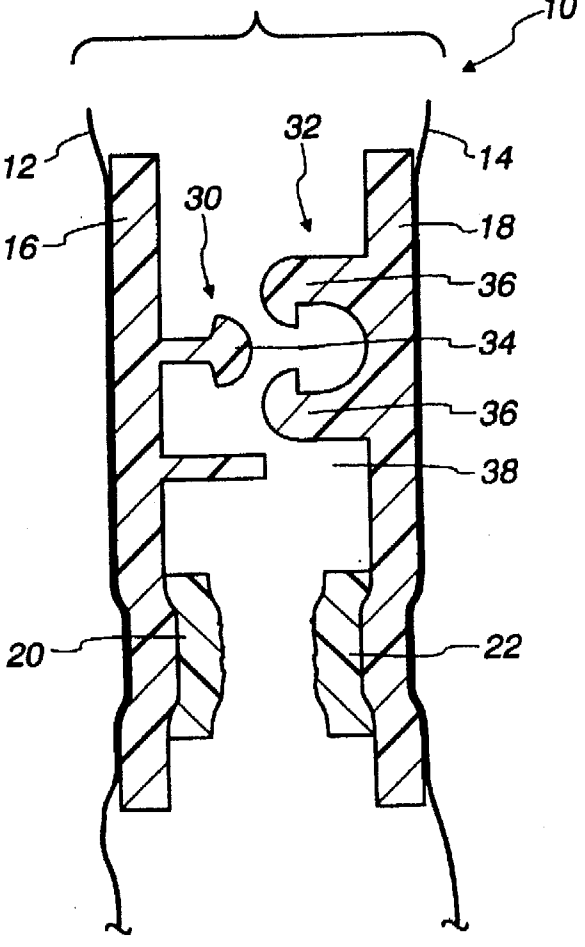
FIG. 3 is the same sectional view as in FIG. 1, after breaking the peelable seal.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

The present invention provides a heat-sealable, peelable composition comprising ethylene vinyl acetate copolymer, polyethylene based wax, and polypropylene. Preferably, the composition comprises about 20% to about 80% ethylene vinyl acetate copolymer, about 5% to about 60% polyethylene based wax, and about 5% to about 60% polypropylene. More preferably, the composition comprises about 20% to about 60% ethylene vinyl acetate copolymer, about 20% to about 60% polyethylene based wax, and about 20% to about 60% polypropylene. Even more preferably, the composition comprises about 30% to about 60% ethylene vinyl acetate copolymer, about 20% to about 50% polyethylene based wax, and about 20% to about 35% polypropylene. Ethylene vinyl acetate (EVA) copolymer, polyethylene based wax, and polypropylene are available commercially.

The peel seals of the present invention have peel seal strengths of between about 0.5 pounds to about 10 pounds per lineal inch of seal width. As used herein, the phrase "lineal inch of seal width" describes a seal that is one inch wide.

Example 1 below shows 14 different compositions with peel seal strengths of between 0.51 pounds and greater than 10 pounds. Preferably, the peel seal strength is from about 2 to about 7 pounds per lineal inch of seal width. Even more preferably, the peel seal strength is from about 3 to about 6 pounds per lineal inch of seal width. In one embodiment, a method of forming a peelable seal using the compositions of the present invention is provided. A peelable seal is prepared by forming a strip of the heat-sealable, peelable composition. The heat-sealable, peelable strip is then heat-sealed to a polymeric bag or to a second heat-sealable, peelable strip. As used herein, the term "strip" is not limited to rectangular or square configurations of the heat-sealable, peelable composition. Rather the term "strip" includes any geometric shape that can be heat-sealed to form a peelable seal. Thus the term "strip" includes any configuration of a heat-sealable, peelable composition that can be heat-sealed to form a peelable seal. Typically, the thickness of the heat-sealable, peelable strip is between about 4 to about 8 mil thick. While the preferred heat-sealable, peelable strip is between 4 and 8 mil thick, variations in the thickness of the strip is contemplated.

The peelable seal is formed by heating and pressing the peelable seal strip between two seal bars. Typically, the seal bars are metal or rubber. For a given heat-sealable, peelable composition, the peel strength of the seal is affected by the temperature, the seal time (dwell), and the pressure at which the composition is heat-sealed. Preferred heat-sealing conditions include seal pressures of about 30 to about 100 pounds per square inch, seal times of between 0.2 to about 2 seconds, and seal bar temperatures of about 150° to about 400° F. With respect to preferred seal bar temperatures, the upper limit of the seal bar temperature is controlled by the temperature at which the polymeric bag begins to decompose. Thus, seal bar tempeatures of greater than 400° F. is contemplated. The manipulation of the conditions needed to form a heat-seal using the compositions as disclosed herein are within the skill of an artisan.

In another embodiment, the peel seal composition can further comprise an ink or a dye. The ink or dye colors the formed peel seal. When the peel seal is broken, an irreversible color change occurs the peel seal area and a customer is warned that the package is no longer hermetically sealed.

Yet another embodiment of the present invention provides a method preparing a heat-sealable, peelable composition. The method comprises admixing ethylene vinyl acetate copolymer, polyethylene based wax and polypropylene. Preferably, ethylene vinyl acetate copolymer, polyethylene based wax and polypropylene are admixed at a temperature of between 340° and 400° F. This method can further comprise admixing an ink or a dye if a colored peelable seal composition is preferred.

Figure 2:
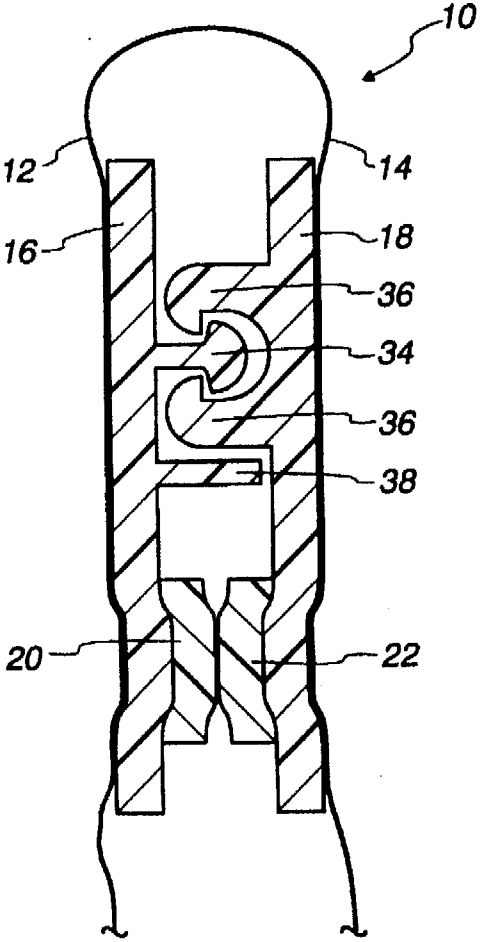
FIG. 2 is the same sectional view as in FIG. 1, after forming the peelable seal.
Figure 1:
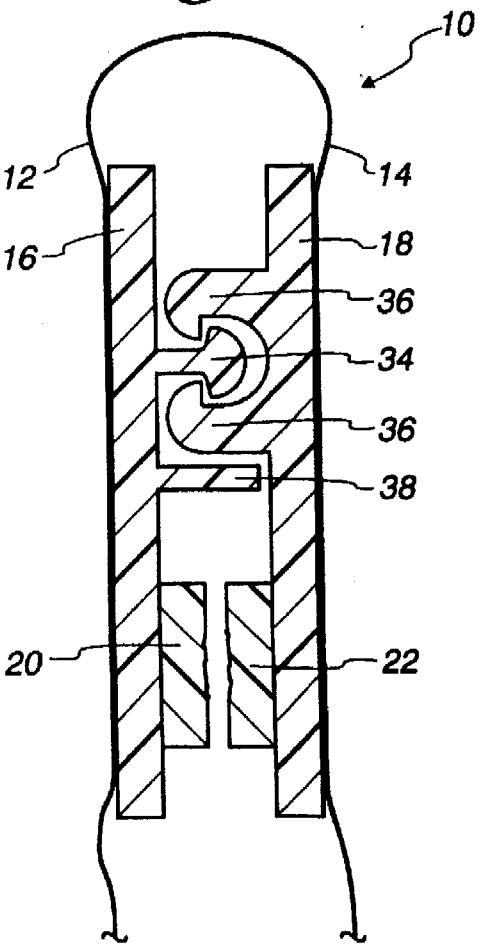
FIG. 1 is a sectional view of a closure arrangement embodying the present invention, prior to forming a peelable seal.

The present invention further provides a closure arrangement for polymeric bags. Turning now to the drawings, FIGS. 1–3 illustrate a sectional view of a closure arrangement 10 for a reclosable bag having a top film 12 and a bottom film 14. The closure arrangement 10 includes a pair of flat transparent base strips 16, 18 and a pair of flat peelable strips 20, 22. The base strips 16, 18 and the peelable strips 20, 22 are disposed at the mouth of the reclosable bag and extend along the length of the bag mouth. Moreover, the base strips 16, 18 and the peelable strips 20, 22 are parallel to each other along the length of the bag mouth. An outer surface of the base strip 16 is firmly attached to an inner surface of the top film 12, and an outer surface of the base strip 18 is firmly attached to an inner surface of the bottom film 14. The peelable strip 20 is attached to the inner surface of the base strip 16, and the peelable strip 22 is attached to the inner surface of the base strip 18. Thus, the peelable strips 20, 22 are situated between the base strips 16, 18.

To provide the closure arrangement 10 with a reclosable zipper, the base strips 16, 18 have integrally formed therewith respective male and female closure profiles 30, 32. The male closure profile 30 extends inwardly from the inner surface of the base strip 16 and includes a single locking member 34 with an expanded head. The female closure profile 32 extends inwardly from the upper flange portion of the base strip 18 and includes a pair of flexible locking members 36 with hooks at the ends thereof. The pair of locking members 36 are disposed opposite the single locking member 34 and are spaced by a sufficient distance that the expanded head of the single locking member 34 is releasably engageable between the pair of locking members 36. More specifically, the pair of locking members 36 interlock with the single male locking member 34 in a snapping action caused by bringing the hooks of the pair of locking members 36 passed the expanded head of the locking member 34. To facilitate alignment of the pair of locking members 36 with the locking member 34 during reclosure, the male closure profile 30 is provided with a guide post 38 for guiding one of the pair of locking members 36 between the guide post 38 and the locking member 34. If desired, the closure arrangement 10 may be designed without a reclosable zipper. In addition, the closure arrangement 10 may be designed without the base strips 16, 18 so that the peelable strips 20, 22 and the closure profiles 30, 32 are attached directly to the respective top and bottom films 12, 14 of the reclosable bag.

The closure arrangement 10 is manufactured using conventional extrusion and heat sealing techniques. In particular, the base strips 16, 18, the peelable strips 20, 22, and the closure profiles 30, 32 are co-extruded through a die plate fed by a plurality of extruders. These extruders carry the different molten materials for forming the base strips 16, 18, the peelable seals 20, 22, and the closure profiles 30, 32. As is well-known in the art, the die plate includes input ports, output ports, and channels connecting these input ports to output ports. The extruders feed the different molten materials to different input ports, and the channels are designed to configure the molten materials into the shapes of the base strips 16, 18, the peelable strips 20, 22, and the closure profiles 30, 32. The output ports are arranged such that the base strips 16, 18, the peelable strips 20, 22, and the closure profiles 30, 32 exit the die plate with the connections shown in FIG. 1. Since the base strip 16, male closure profile 30, and the peelable strip 20 are separated from the base strip 18, the female closure profile 32, and the peelable strip 22, it should be apparent that these two separate sets of elements may be formed in separate extrusions using two different die plates.

After extruding the base strips 16, 18, the peelable strips 20, 22, and the closure profiles 30, 32, the top and bottom films 12, 14 are heat-fused to the respective base strips 16, 18 using heat seal bars. These heat seal bars are also employed to generate a peelable seal between the peelable strips 20, 22 (FIG. 2).

During manufacture of the closure arrangement 10, the various bonds or attachments between different materials are formed such that the weakest bond is formed at the location of the peelable seal. By forming the weakest bond at the location of the peelable seal, the application of opening forces to the closure arrangement 10 will cause the peelable seal to rupture first. Since the other bonds are stronger than the peelable seal, these other bonds will not rupture in response to the application of opening forces.

The peelable strips 20, 22 are disposed opposite each other along the length of the bag mouth so that they may be heat sealed to form a peelable seal between the peelable strip 20, 22. Prior to forming the peelable seal, the peelable strips 20, 22 are unattached as shown in FIG. 1. After forming the peelable seal, the peelable strips 20, 22 are attached to each other (FIG. 2). As shown in FIG. 2, after forming the peelable seal but prior to initially opening a polymeric bag incorporating the closure arrangement 10, the peelable seal formed by the peelable strips 20, 22 is intact, the closure profiles 30, 32 are interlocked with each other, and the top and bottom films 12, 14 are connected at the mouth end of the bag. The top and bottom films 12, 14 either are heat-fused together at the mouth end of the bag or are formed from a single piece of film. Since the peelable seal between the peelable strips 20, 22 already provides a hermetic seal for the bag, the top and bottom films 12, 14 may alternatively be disconnected from each other at the mouth end.

Referring to FIG. 3, to open the bag, the top and bottom films 12, 14 are separated from each other by cutting them apart. Next, the interlocked closure profiles 30, 32 are detached from each other by grabbing onto the top and bottom films 12, 14 and pulling them apart. Finally, the peelable seal between the peelable strips 20, 22 is broken by continuing to pull the top and bottom films 12, 14 in opposite directions. During breakage of the peelable seal, the peelable strip 20 remains attached to the base strip 16, and the peelable strip 22 remains attached to the base strip 18.

To provide evidence of tampering, breaking the peelable seal of the closure arrangement 10 causes the peelable seal region to undergo a change in appearance and texture. This change in appearance provides the consumer with a visual indication that the peelable seal has been broken. In one embodiment, the peelable strip 20 is dyed a first opaque color such as blue, black, purple, green, etc., and the peelable strip 22 is dyed a second color, such as yellow, white, orange, etc., which is lighter than the first color. This second color may either be somewhat translucent or virtually opaque.

When the peelable strips 20, 22 are aligned next to one another prior to forming the peelable seal (FIG. 1), the darker first color of the peelable strip 20 cannot be seen through the lighter second color of the peelable strip 22 when viewing the polymeric bag from the right side in FIG. 1. The second color of the peelable strip 22 substantially masks the first color of the peelable strip 20. Similarly, lighter second color of the peelable strip 22 cannot be observed through the darker first color of the peelable strip 20 when viewing the polymeric bag from the left side in FIG. 1. When, however, the two peelable strips 20, 22 are heat sealed to each other to form a peelable seal, the darker first color of the peelable strip 20 is clearly visible through the lighter second color of the peelable strip 22 only in the area that has been heat sealed by a heat seal bar, though minute speckles of the lighter color may remain visible in the heat seal area. In one embodiment, the color of the heat sealed area is a blend of the first and second colors. The portion of the peelable strip 20 outside the heat-sealed area remains hidden or obscured by the peelable strip 22. After the peelable seal is broken, by accident in transit or by deliberate tampering, the darker color will no longer show through the lighter color. This masking condition is irreversible so that once the peelable seal is broken, the peelable seal can never again resemble an intact seal. In addition to generating the masking condition, breaking the peelable seal also roughens the texture of the peelable strips 20, 22.

If, for example, the first opaque color is blue and the second opaque color is yellow, forming a peelable seal allows one to see the blue color of the peelable strip 20 through the yellow peelable strip 22 only in the area where the heat seal bar has been applied. In one embodiment, the heat sealed area is a slightly different shade of blue compared to the original blue color of the peelable strip 20. Once the peelable seal is broken, the blue color of the peelable strip 20 will no longer be visible through the yellow peelable strip 22. The yellow peelable strip 22 substantially conceals the blue peelable strip 22 even if the two peelable strips 20, 22 are manually pressed together. As stated above, this masking condition is irreversible.

In an alternative embodiment, the peelable strips 20, 22 are each colorless and are each translucent or hazy due to the roughened inner surfaces of the peelable strips 20, 22. When the peelable strips 20, 22 are lying atop one another but are not yet heat sealed to one another, the area of the peelable strips 20, 22 is opaque or hazy. When, however, the two peelable strips 20, 22 are heat sealed to each other to form a peelable seal, the area where a heat seal bar has been applied is substantially clear because the heat seal bar smooths the roughened surfaces of the peelable strips 20, 22 in the area of the peelable seal. When the peelable seal is broken, the area of the peelable seal reverts back to being hazy.

Figure 6:
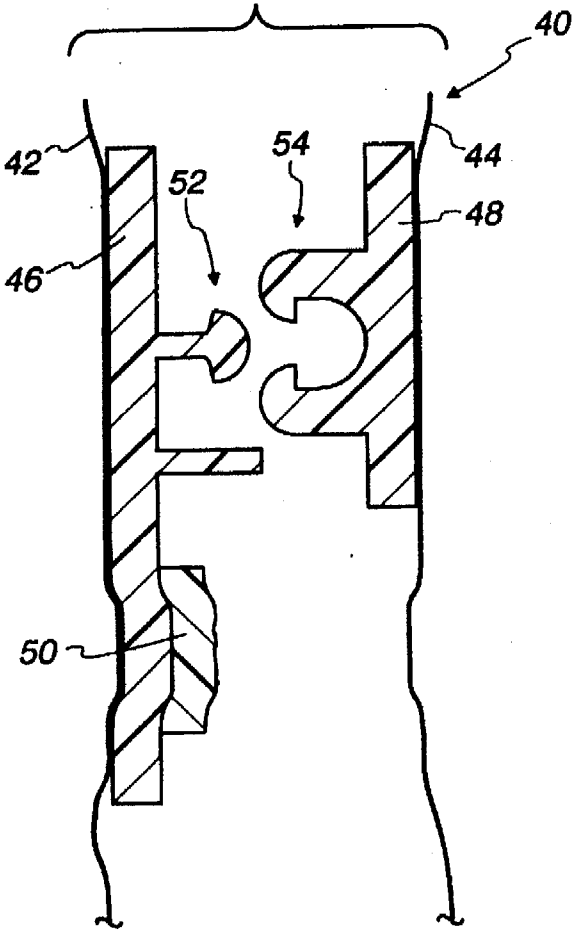
FIG. 6 is the same sectional view as in FIG. 4, after breaking the peelable seal.
Figure 5:
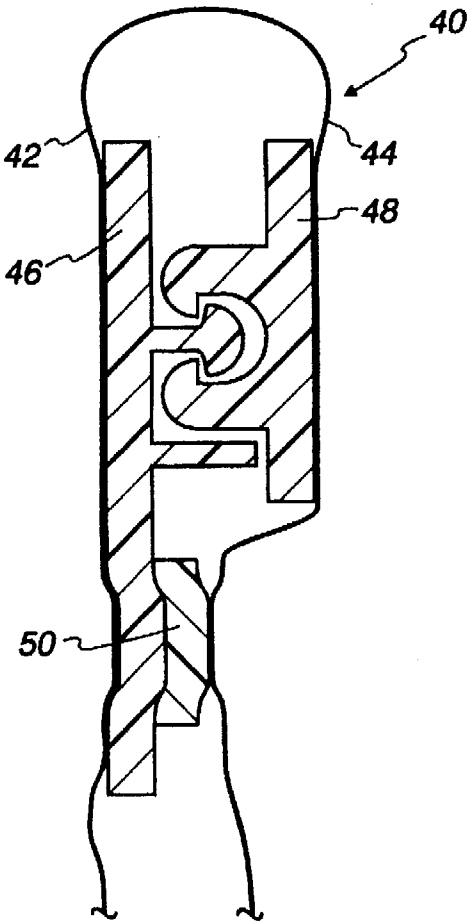
FIG. 5 is the same sectional view as in FIG. 4, after forming the peelable seal.
Figure 4:
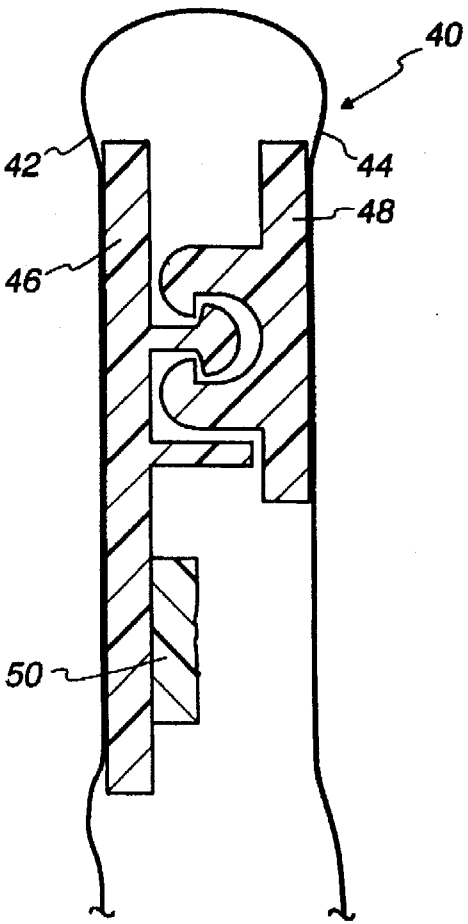
FIG. 4 is a sectional view of another closure arrangement embodying the present invention, prior to forming a peelable seal.

FIGS. 4–6 illustrate an alternative closure arrangement 40 for a reclosable bag having a top film 42 and a bottom film 44. The closure arrangement 40 includes a pair of flat transparent base strips 46, 48 and a single flat peelable strip 50. The base strips 46, 48 and the peelable strip 50 are disposed at the mouth of the reclosable bag and extend along the length of the bag mouth. An outer surface of the base strip 46 is firmly attached to an inner surface of the top film 42. The base strip 48 is generally parallel to and opposes the base strip 46, and an outer surface of the base strip 48 is firmly attached to an inner surface of the bottom film 44. To accommodate the peelable strip 50, the base strip 46 is wider, i.e., has a longer vertical dimension in FIGS. 4–6, than the base strip 48. The peelable strip 50 is attached to the inner surface of the base strip 46 and is disposed between the base strip 46 and the bottom film 44. If desired, the base strips 46, 48 may be provided with a reclosable zipper with associated male and female closure profiles 52, 54. The interaction of these closure profiles 52, 54 is identical to the interaction of the closure profiles 30, 32 described in connection with FIGS. 1–3.

Like the closure arrangement 10 in FIGS. 1–3, the closure arrangement 40 in FIGS. 4–6 is manufactured using conventional extrusion and heat sealing techniques. The base strips 46, 48, the peelable strip 50, and the closure profiles 52, 54 are preferably co-extruded with each other through a single die plate. If desired, however, separate die plates may be used to separately extrude the opposite sides of the closure arrangement 40. After extruding the aforementioned elements of the closure arrangement 40, the top and bottom films 42, 44 are heat-fused using heat seal bars to the respective base strips 46, 48. These heat seal bars are also employed to generate a peelable seal between the peelable strip 50 and the bottom film 44 (FIG. 5).

Prior to forming the peelable seal, the peelable strip 50 and the bottom film 44 are unattached as shown in FIG. 4. After forming the peelable seal, the peelable strip 50 is attached to the bottom film 44 (FIG. 5). As shown in FIG. 5, after forming the peelable seal but prior to initially opening a polymeric bag incorporating the closure arrangement 40, the peelable seal formed by the peelable strip 50 and the bottom film 44 is intact, the closure profiles 52, 54 are interlocked with each other, and the top and bottom films 42, 44 are connected at the mouth end of the bag. The top and bottom films 42, 44 either are heat-fused together at the mouth end of the bag or are formed from a single piece of film. Since the peelable seal between the peelable strip 50 and the bottom film 44 already provides a hermetic seal for the bag, the top and bottom films 42, 44 may alternatively be disconnected from each other at the mouth end.

Referring to FIG. 6, to open the bag, the top and bottom films 42, 44 are separated from each other by cutting them apart. Next, the interlocked closure profiles 52, 54 are detached from each other by grabbing onto the top and bottom films 42, 44 and pulling them apart. Finally, the peelable seal between the peelable strip 50 and the bottom film 44 is broken by continuing to pull the top and bottom films 42, 44 in opposite directions. During breakage of the peelable seal, the peelable strip 50 remains attached to the base strip 46.

To provide evidence of tampering, breaking the peelable seal of the closure arrangement 40 causes the peelable seal region to undergo a change in appearance and texture. This change in appearance is a visual signal that the peelable seal has been broken. The bottom film 44 of the polymeric bag is pigmented a somewhat translucent first color, such as white, yellow, orange, etc., either by being printed with a layer of ink or being dyed with ink. If desired, this first color may be virtually opaque. The peelable strip 50 is dyed a second opaque color, such as blue, black, purple, green, etc., which is darker than the first color of the bottom film 44.

When the peelable strip 50 and the bottom film 44 are aligned next to one another prior to forming the peelable seal (FIG. 4), the darker second color of the peelable strip 50 can hardly be seen through the lighter first color of the bottom film 44 when viewing the polymeric bag from the right side in FIG. 4. The first color of the bottom film 44 substantially masks the second color of the peelable strip 50. When the darker peelable seal 50 is heat sealed to the lighter colored bottom film 44 to form a peelable seal, the darker second color of the peelable strip 50 is clearly visible through the lighter first color of the bottom film 44 in the area that has been heat sealed by a heat seal bar. The bottom film 44 still substantially obscures the second color of the peelable strip 50 in the area outside the heat sealed area. When, however, the peelable seal between the peelable strip 50 and the bottom film 44 is broken, the darker peelable strip 50 can barely be seen through the lighter colored bottom film 44, even when the peelable strip 50 and the bottom film 44 are manually pressed together. This masking condition is irreversible.

If, for example, the bottom film 44 is colored white and the peelable strip 50 is colored opaque blue, the formation of a peelable seal allows one to see the blue color of the peelable strip 50 through the white bottom film 44 in the area where the heat seal bar was applied. Once the peelable seal is broken, the blue color of the peelable strip 50 will barely be visible through the white bottom film 44. The white bottom film 44 substantially conceals the blue peelable strip 50 even if the peelable strip 50 and the bottom film 44 are manually pressed together.

The preferred compositions of the various portions of the closure arrangements 10 and 40 are described herein. The heat-sealable, peelable composition used to form the peelable strips 20, 22 in FIGS. 1–3 and the peelable strip 50 in FIGS. 4–6 consist essentially of three components. First, the peelable material includes an ethylene vinyl acetate copolymer such as Product No. AT 3325M EVA manufactured by AT Plastics, Inc. of Edmonton, Alberta, Canada or ULTRATHENE® UE654.67 from Quantum Chemical Co., USI Division Cincinnati, Ohio. Second, the peelable material includes a polyethylene-based wax such as C-15 EPOLENE® wax manufactured by Eastman Chemical Company of Longview, Tex. Third, the peelable material includes a polypropylene such as ESCORENE® manufactured by Exxon Chemical Company of Baytown, Tex. Polypropylene is widely available from many other commercial sources. The weight percentages of the foregoing three components of the peelable material preferably are between 20% to 80% EVA copolymer, about 5% to about 60% polyethylene-based wax, and about 5% to about 60% polypropylene. The heat-sealable, peelable composition can be colored as described previously by the addition of an appropriate ink or dye. Inks and dyes are available commercially from Ampacet Corp. (Tarrytown, N.Y.), Colortek, Inc. (Brampton, Ontario, Canada), and Carolina Color Corp. (Salisbury, N.C.).

The base material used to form the base strips 16, 18 in FIGS. 1–3, the closure profiles 30, 32 in FIGS. 1–3, the base strips 46, 48 in FIGS. 4–6, and the closure profiles 52, 54 in FIGS. 4–6 is preferably composed of a heat resistant mixture of two components. First, the base material includes a low density polyethylene such as Product No. 412FA manufactured by Westlake Polymers Corporation of Lake Charles, La. Second, the base material also includes EVA copolymer manufactured by Exxon Chemical Co. as product N-722.62. The preferred weight percentages are 90% low density polyethylene and 10% EVA copolymer. Alternatively, the base material may be composed of REXENE® 1205C manufactured by Rexene Corporation of Odessa, Tex. The primary characteristics of the base material are that it bonds readily to the peelable material of the peelable strips and it provides a modicum of thermal resistance so that it does not melt while bonding other materials thereto.

The top and bottom films 12, 14 in FIGS. 1–3 and the top and bottom films 42, 44 in FIGS. 4–6 are preferably composed of two or more layers of material. The outer layer of material is a heat-resistant material such as polyethylene terephthalate, oriented polypropylene, or biaxially-oriented nylon. The inner layer of material is a sealant material such as a combination of low density polyethylene and ethylene vinyl acetate.

EXAMPLE 1

Fourteen different heat-sealable, peelable compositions comprising between about 20% to about 60% ethylene vinyl acetate copolymer, about 20% to about 60% polyethylene based wax, and about 20% to about 60% polypropylene were prepared. Table 1 lists the specific compositions. Peelable seals made of the 14 compositions were prepared between 280° and 380° F. at 80 pounds per square inch (PSI) with a dwell time of 0.6 seconds. The top seal bar was heated as indicated and the bottom seal bar was heated to 150° F. The width of the seal bars were 5 mm.

A long heat-sealable, peelable strip was prepared and heat-sealed onto the inner surfaces of a polymeric bag (e.g. top and bottom films 42 and 44, of FIG. 4) and were cooled to room temperature. The polymeric bag including the peel seal was cut into one inch wide pieces for peel seal strength testing. This one inch wide piece provides a lineal inch of seal width for peel seal strength testing. The peel strength of the peel seal was tested on a tensile strength tester by pulling apart the one inch wide strips. The force required to pull apart the peel seal was measured. The force, reported in pounds per lineal inch of seal width, in tables 2, 3 and 4 below, is the peak force required to completely pull apart the peel seal as measured in a tensile strength tester (Model No. L400-FM-30 from Thwing Albert Instrument Co. in Philadelphia, Pa.). Each of the values reported below in tables 2, 3, and 4 is the average of 5 samples. Tables 2, 3, and 4 also report the standard deviations. The data in table 2 shows that peel seal strengths of between 0.5 pounds to greater than 10 pounds per lineal inch of seal width can be obtained from the compositions of the present invention. For this example and example 2 below, the presence or absence of the reclosable zipper with associated male and female closure profiles 52, 54 (FIG. 6), does not affect the force required to pull apart a peel seal.

TABLE 1

| SAMPLE NO. | EVA | WAX | POLYPROPYLENE |
|---|---|---|---|
| 1 | 40.00 | 40.00 | 20.00 |
| 2 | 40.00 | 40.00 | 20.00 |
| 3 | 20.00 | 60.00 | 20.00 |
| 4 | 20.00 | 20.00 | 60.00 |
| 5 | 40.00 | 20.00 | 40.00 |
| 6 | 20.00 | 20.00 | 60.00 |
| 7 | 60.00 | 20.00 | 20.00 |
| 8 | 26.67 | 46.67 | 26.67 |
| 9 | 26.67 | 26.67 | 46.67 |
| 10 | 60.00 | 20.00 | 20.00 |
| 11 | 20.00 | 60.00 | 20.00 |
| 12 | 46.67 | 26.67 | 26.67 |
| 13 | 33.33 | 33.33 | 33.33 |
| 14 | 20.00 | 40.00 | 40.00 |

TABLE 2

| | |
|---|---|
| PSI: | 80 |
| DWELL: | 0.60 SEC |
| TOP SEAL BAR (HEATED): | 5 mm RAISED |
| BOTTOM BAR (HEATED): | 5 mm (ALWAYS SET AT 160° F.) |

| SAMPLE NO. | 280° F. LBS/SD | 290° F. LBS/SD | 300° F. LBS/SD | 310° F. LBS/SD | 320° F. LBS/SD | 330° F. LBS/SD | 340° F. LBS/SD | 350° F. LBS/SD | 360° F. LBS/SD | 370° F. LBS/SD | 380° F. LBS/SD |
|---|---|---|---|---|---|---|---|---|---|---|---|
| 1 | 3.47/.29 | 3.78/.27 | 4.09/.56 | 3.87/.44 | 4.84/.94 | 4.24/.24 | 4.01/.42 | 4.19/1.20 | 4.16/.36 | 3.16/.67 | 4.57/.69 |
| 2 | 3.37/.11 | 3.48/.31 | 3.39/.23 | 4.10/.41 | 3.82/.39 | 3.62/.32 | 3.89/.20 | 3.68/.41 | 3.89/.59 | 3.75/.48 | 4.16/.45 |
| 3 | 2.38/.33 | 2.71/.25 | 2.80/.30 | 3.18/.46 | 3.16/.37 | 2.21/.76 | 3.17/.44 | 3.56/.37 | 3.61/.61 | 2.97/.29 | 3.59/.99 |
| 4 | .51/.03 | .63/.02 | .86/.08 | .83/.05 | 1.21/.24 | 1.09/.27 | .87/.15 | 1.38/.44 | 1.31/.35 | 1.45/.53 | 1.22/.24 |
| 5 | 2.92/.24 | 3.18/.37 | 2.68/.23 | 2.65/.24 | 2.40/.24 | 2.49/.13 | 2.70/.20 | 2.39/.21 | 2.45/.11 | 2.21/.31 | 2.09/.42 |
| 6 | .55/.03 | .62/.08 | .63/.08 | .94/.06 | .91/.12 | .98/.18 | 1.13/.22 | 1.18/.17 | 1.31/.36 | 1.65/.21 | 1.88/.30 |
| 7 | 4.88/.50 | 5.05/.80 | 4.96/1.07 | 5.45/.53 | 6.40/.24 | 6.32/.39 | 7.03/.79 | 6.03/1.24 | 7.49/.62 | 7.74/.53 | 6.55/.83 |
| 8 | 2.65/.20 | 2.67/.16 | 2.75/.43 | 2.75/.39 | 2.98/.31 | 2.66/.21 | 2.56/.29 | 3.10/.30 | 2.82/.39 | 3.08/.54 | 3.44/.48 |
| 9 | 2.01/.33 | 2.19/.14 | 2.11/.37 | 2.12/.27 | 1.98/.27 | 2.10/.19 | 1.84/.04 | 1.84/.15 | 1.87/.22 | 1.78/.17 | 1.71/.12 |
| 10 | 4.82/.69 | 2.19/1.53 | 5.22/.29 | 4.52/.50 | 5.09/.37 | 5.12/.37 | 5.82/.10 | 5.38/.09 | 5.54/1.05 | 5.83/.61 | 5.28/.42 |
| 11 | 2.68/.33 | 1.94/.52 | 1.97/.32 | 2.23/.62 | 2.61/.62 | 1.48/.40 | 1.22/.32 | 3.13/.58 | 1.64/.17 | 2.06/.17 | NR>10.0 |
| 12 | 3.45/.09 | 3.54/.21 | 3.25/.34 | 3.44/.18 | 3.38/.26 | 3.32/.19 | 3.07/.28 | 3.46/.12 | 3.25/.54 | 2.72/.29 | 3.34/1.46 |
| 13 | 3.06/.11 | 2.91/.12 | 2.80/.19 | 2.82/.32 | 2.87/.41 | 2.20/.39 | 1.96/.25 | 2.16/.47 | 1.77/.24 | 1.64/.18 | 2.68/1.08 |
| 14 | 1.89/.08 | 1.72/.16 | 1.89/.34 | 1.89/.13 | 1.62/.25 | 1.74/.29 | 1.64/.12 | 1.74/.47 | 1.52/.16 | 1.64/.42 | 1.94/.43 |

EXAMPLE 2

A heat-sealable, peelable composition comprising about 50% ethylene vinyl acetate copolymer, about 25% polyethylene based wax, and about 25% polypropylene was prepared. Peelable seals were formed using metal to metal seal bars (table 3) or metal to rubber seal bars (table 4). The seal times, seal pressures and the temperatures of the seal bars were as indicated. The data in tables 3 and 4 shows that for a given composition, seal strengths between about 3.1 pounds to about 5.4 pounds per lineal inch of seal width can be obtained depending upon the sealing conditions.

TABLE 3

METAL TO METAL SEAL BARS, BOTH 5 MM WIDE
ONE BAR HEATED TO TEMP INDICATED
OPPOSITE BAR HEATED TO 100° F.

| SEAL TIME SECS. | SEAL PRESS PSI | 300° F. LBS/SD | 350° F. LBS/SD | 400° F. LBS/ST |
|---|---|---|---|---|
| 0.4 | 60 | 3.3/0.2 | 4.2/0.3 | 3.3/0.1 |
| 0.5 | 80 | 4.2/0.3 | 4.8/0.6 | 3.3/0.1 |
| 0.6 | 100 | 4.1/0.3 | 4.1/0.3 | 4.8/0.8 |

TABLE 4

METAL TO METAL SEAL BARS, METAL BOTH HEATED TO
TEMPERATURE INDICATED, RUBBER BAR NOT HEATED
RUBBER IS 1/8 THICK, AND IS 45 DUROMETER

| SEAL TIME SECS. | SEAL PRESS PSI | 300° F. LBS/SD | 350° F. LBS/SD | 400° F. LBS/ST |
|---|---|---|---|---|
| 0.4 | 60 | 3.1/0.4 | 3.6/0.3 | 4.3/0.3 |
| 0.5 | 80 | 3.6/0.3 | 4.5/0.3 | 4.6/0.2 |
| 0.6 | 100 | 4.1/0.3 | 5.0/0.2 | 5.4/0.8 |

While the present invention has been described with reference to several particular embodiments, those skilled in the art will recognize that many changes may be made thereto without departing from the spirit and scope of the present invention.

For example, ethylene vinyl acetate copolymer, polyethylene based wax, and polypropylene can be obtained from sources other than those specifically mentioned herein. The sealing conditions can be modified to provide either a weaker or stronger seal, as shown in example 2 above.

In addition, the closure arrangements 10 and 40 may be modified either to remove the reclosable zipper or to position the reclosable zipper below, instead of above, the peelable seal. In the latter situation, the base strips of each closure arrangement are provided with a lower flange portion with closure profiles attached respectively thereto. Furthermore, the closure arrangements 10 and 40 may be designed without their base strips so that the peelable strips and the reclosable zippers are attached directly to the top and bottom films of the reclosable bag.

Furthermore, the closure arrangement 40 in FIGS. 4–6 may be designed to provide a peelable seal between the peelable strip 50 and the base strip 48, where the base strip 48 is widened to appear similar to the base strip 18 in FIGS. 1–3. In this case, the widened base strip 48 is pigmented the lighter first color, and the peelable strip 50 is still pigmented the darker second color.

Each of these embodiments and obvious variations thereof is contemplated as falling within the spirit and scope of the claimed invention, which is set forth in the following claims.

What is claimed:

1. A method of forming a peelable seal comprising preparing a heat-sealable, peelable strip from a composition comprising about 20% to about 80% ethylene vinyl acetate copolymer, about 5% to about 60% polyethylene based wax, and about 5% to about 60% polypropylene and heat-sealing said heat-sealable, peelable strip.

2. The method of claim 1 wherein said heat-sealable, peelable strip is heat sealed to a surface of a polymeric film.

3. The method of claim 1 wherein said heat-sealable, peelable strip is heat sealed to a second heat-sealable, peelable strip.

4. The method of claim 1 wherein said heat-sealable, peelable strip is heat sealed at a temperature of between about 230° to about 400° F., at a seal pressure of between about 30 to about 100 pounds per square inch, and for a seal time of between about 0.3 to about 2 seconds.

5. The method of claim 1 wherein the peel seal strength of said peelable seal is from about 2 to about 7 pounds per lineal inch of seal width.

6. The method of claim 1 wherein the peel seal strength of said peelable seal is from about 3 to about 6 pounds per lineal inch of seal width.

7. A method of preparing a heat-sealable, peelable composition comprising admixing, at a temperature of between about 340° and about 400° F., ethylene vinyl acetate copolymer, polyethylene based wax, and polypropylene to form said heat-sealable, peelable composition.

8. The method of claim 7 wherein said heat-sealable, peelable composition is prepared by admixing about 20% to about 80% ethylene vinyl acetate copolymer, about 5% to about 60% polyethylene based wax, and about 5% to about 60% polypropylene.

9. The method of claim 7 wherein said heat-sealable, peelable composition is prepared by admixing about 20% to about 60% ethylene vinyl acetate copolymer, about 20% to about 60% polyethylene based wax, and about 20% to about 60% polypropylene.

10. The method of claim 7 wherein said heat-sealable, peelable composition is prepared by admixing about 30% to about 60% ethylene vinyl acetate copolymer, about 20% to about 50% polyethylene based wax, and about 20% to about 35% polypropylene.

11. The method of claim 7 further comprising admixing an ink or a dye.

* * * * *